US005562122A

United States Patent [19]

Lundbäck

[11] Patent Number: 5,562,122

[45] Date of Patent: Oct. 8, 1996

[54] FLUID PRESSURE BIASED FLUID VALVE DEVICE

[75] Inventor: Stig Lundbäck, Vaxholm, Sweden

[73] Assignee: Humanteknik A.B., Stockholm, Sweden

[21] Appl. No.: 582,869

[22] Filed: Jan. 4, 1996

Related U.S. Application Data

[62] Division of Ser. No. 364,847, Dec. 23, 1994, which is a continuation of Ser. No. 214,657, Mar. 16, 1994, abandoned, which is a continuation of Ser. No. 838,746, filed as PCT/SE91/0048, Jun. 7, 1991, abandoned.

[30] Foreign Application Priority Data

Jun. 7, 1990 [SE] Sweden ..... 9002044

[51] Int. Cl.[6] ..... F16K 31/12

[52] U.S. Cl. ..... 137/509; 137/494; 417/560

[58] Field of Search ..... 137/494, 509; 417/507, 560

[56] References Cited

U.S. PATENT DOCUMENTS

| | | | |
|---|---|---|---|
| 1,284,951 | 11/1918 | Buckland et al. | 137/494 |
| 1,284,952 | 11/1918 | Buckland et al. | 137/494 |
| 3,886,969 | 6/1975 | Shira et al. | 137/509 |

FOREIGN PATENT DOCUMENTS

| | | |
|---|---|---|
| 510839 | 7/1980 | Australia . |
| 879637 | 3/1943 | France . |
| 857142 | 4/1953 | Germany . |
| 146109 | 4/1982 | Norway . |
| WO90/08898 | 8/1990 | WIPO . |

*Primary Examiner*—Timothy S. Thorpe
*Assistant Examiner*—Roland G. McAndrews, Jr.
*Attorney, Agent, or Firm*—White & Case

[57] ABSTRACT

A fluid valve device for on-off control of fluid flow through a passage extending between two fluid ports (12, 15) and including a valve seat (17A) comprises a hollow valve member (21) which is movable into and out of sealing engagement with the valve seat and defines a valve chamber (20). The valve chamber (20) communicates with one of the fluid ports (15) through the valve seat (17A) and is associated with a valve member actuating device (A) which translates the pressure of the fluid received in the valve chamber (20) from an inlet (12/14) for the fluid flow into a force acting on the valve member to displace it relative to the valve seat (17A). The valve member actuating device in one embodiment includes a thrust surface (A) on the valve member (21) which is directed away from the valve seat and forms part of the wall of the valve chamber (20). A second thrust surface (C) on the valve member (21) is directed oppositely and defines a chamber (V) which is isolated from the valve chamber and the flow passage. A positive-displacement pump includes the fluid valve device as an inlet valve for controlling the admission into the pump chamber (20) of the fluid being pumped.

7 Claims, 3 Drawing Sheets

FLUID PRESSURE BIASED FLUID VALVE DEVICE

This application is a divisional of application Ser. No. 08/364,847, filed on Dec. 23, 1994, which is a continuation of Mar. application Ser. No. 08/214,657, filed on Mar. 16, 1994 (abandoned), which is a continuation of application Ser. No. 07/838,746, filed on Mar. 17, 1992 (abandoned), which is a Rule 371 continuation of PCT/SE91/00408 filed Jun. 7, 1991.

This invention relates to a fluid valve device for controlling the flow of a fluid and to a positive-displacement pump including such a valve device.

Although not limited exclusively to use as an inlet valve in a positive-displacement pump, the valve device according to the invention is particularly useful for such applications. It therefore will be described herein with special reference to its use as an inlet valve in a positive-displacement pump, namely a positive-displacement pump in which a reciprocable displacement member repetitively contracts a pump chamber to expel liquid received in the pump chamber.

A positive-displacement pump has a pump chamber which communicates with an inlet and an outlet and includes a movable wall or wall section forming part of or cooperating with the displacement member. A inlet valve controls the flow of fluid into the pump chamber from the inlet by opening and closing a flow passage which opens into the pump chamber. Most positive-displacement pumps also include an outlet valve which prevents backflow of fluid from the outlet into the pump chamber, but in some cases such a valve can be dispensed with.

The flow passage through which the fluid being pumped enters the pump chamber often causes a serious limitation of the output and efficiency of the pump. Usually, the fluid being pumped enters the inlet and the pump chamber at a relatively low pressure; in many cases the inflow takes place under the action of a partial vacuum in the pump chamber. In order that the pump chamber may be filled rapidly and with small losses of energy, the inlet valve has to be able to open a flow passage of large cross-section area and of a shape such that the resistance to flow of the fluid is minimized. In known positive-displacement pumps, this retirement is difficult to reconcile with the retirement for small dimensions. This is particularly so in pumps which are to operate at high stroke rates.

EP-A-0 374 115 discloses positive-displacement pumps which represent an advantageous solution to the problem of providing for a rapid filling of the pump chamber with small energy losses. An important feature of this solution resides in a gap-like flow passage which extends over the entire circumference, or at least over a substantial portion of the circumference, of the pump chamber and which can be opened over the entire circumferential extent thereof to admit fluid into the pump chamber. In preferred embodiments a variable-volume supply compartment or reservoir is provided adjacent the inlet valve on the upstream side thereof so that a supply of fluid for filling the pump chamber is available very close to the inlet valve; the supply is replenished during the ejection stroke of the pump so as to be available again when the next ejection stroke commences. Because of its large circumferential extent, the flow passage already has a large cross-section area after a short opening movement of the inlet valve, and as the inflow into the pump chamber takes place from all or almost all directions, the flow path is relatively short for most of the fluid that enters the pump chamber.

In some of the embodiments illustrated in the just-mentioned publication, the inlet valve is a mechanical, positively operated valve while in others of the illustrated embodiments a flow-direction controlled non-return valve, namely a flap valve, is used. In certain other embodiments which are not illustrated, the inlet valve is a combination of the two types of valve.

Objects of the present invention are to provide fluid valve devices which are useful in positive-displacement pumps, especially positive-displacement pumps of the kind discussed above, and to provide an improved positive-displacement pump.

To this end, there is provided according to the invention fluid valve devices and positive-displacement pumps as defined in the claims.

As will become clear from the following description, the valve device according to the invention is neither controlled mechanically by a positively acting valve operating mechanism nor controlled by the direction of the fluid flow through it. Instead, it is controlled by the pressure or the force which the fluid being received by the valve device applies to a valve member that is movable into and out of sealing engagement with a valve seat. The fluid whose pressure controls the displacement of the valve member is received in a valve chamber defined by the valve member and preferaly acts on the valve member over a thrust surface located downstream of the flow passage which the valve member opens when it disengages from the valve seat.

Additional objects, features and advantages of the invention will become apparent from the following description of embodiments of the invention, reference being had to the accompanying drawings.

Figure 1:
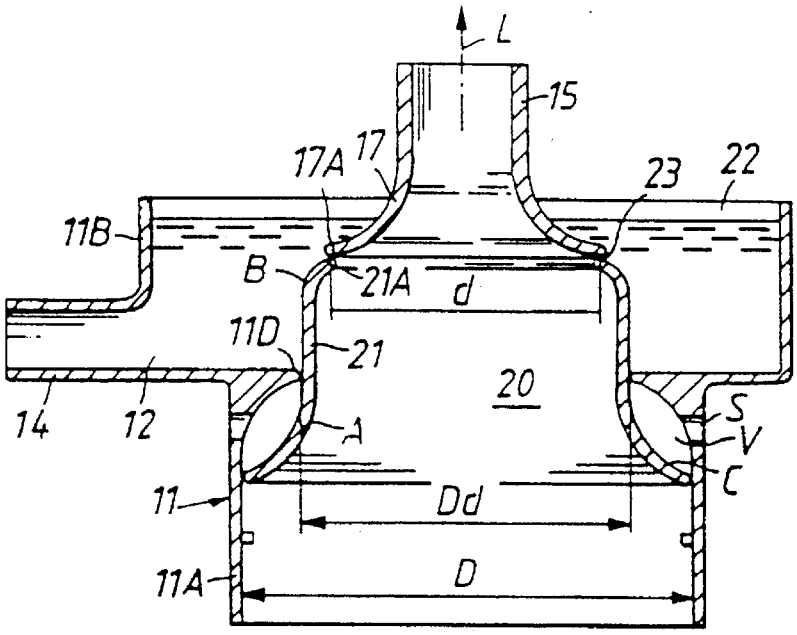
FIGS. 1 and 2 are diagrammatic vertical sectional views of a valve device according to the invention shown in closed position in FIG. 1 and in open position in FIG. 2.
Figure 2:
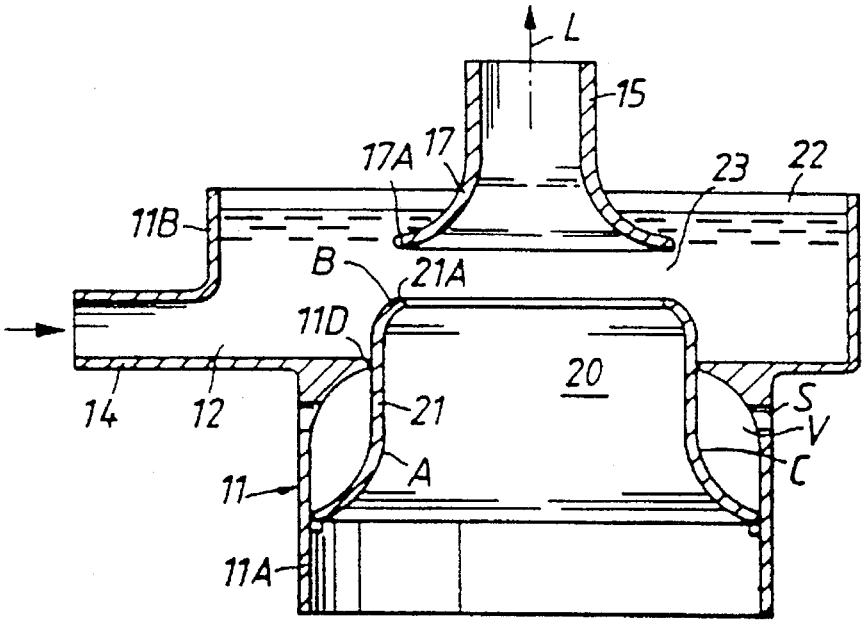

The fluid valve device shown by way of example in FIGS. 1 and 2 comprises a body or housing 11 having an inlet 12 with an associated feed conduit 14 for a fluid, namely a liquid, the passage of which the valve device controls in a two-position or on-off mode (open-closed valve).

A vertically extending outlet conduit for the fluid being passed through the valve device is designated by 15. The lower portion 17 of the outlet conduit is flared and has a downwardly facing annular rim 17A which forms a stationary valve seat.

A valve chamber 20 in the valve device is defined laterally by a vertically displaceable valve member 21 in the housing 11. The valve member 21 is in the shape of a short length of tube which is constricted at its upper end to form an annular sealing portion 21A adapted to engage and seal against the annular valve seat 17A on the flared lower portion 17 of the outlet conduit 15.

The lower end of the valve member 21 is flared and constantly is in sliding sealing engagement with the inner side of a cylindrical, downwardly directed portion 11A of the housing 11.

An intermediate cylindrical portion of the valve member 21 constantly is in sliding sealing engagement with an annular, inwardly directed lip 11D of the housing. Between this lip and the flared lower valve member end, the valve member 21 together with the housing portion 11A defines a compartment V which is filled with air and in open communication with the surrounding atmosphere through an opening S. As the valve member 21 moves axially towards and away from the valve seat 17A, the air compartment V accommodates the variations in volume which the valve chamber 20 undergoes.

At its upper portion 11B the housing 11 defines a supply compartment or reservoir 22. This compartment or reservoir is open at the top of the housing and holds liquid up to a level which may vary but is here presumed always to be higher than the level of the valve seat 17A. If desired, a water seal (not shown) may be provided on the upstream side of the valve seat.

FIGS. 1 and 2 show no bottom wall or other downward limitation of the valve chamber 20. Depending on the application of the valve device, there may be a fixed or movable bottom wall. A movable bottom wall may be in the form of a pump piston which is movable up and down in the lower housing portion 11A as in the positive-displacement pump described below. It is not necessary, however, for the valve device to include a bottom wall of the valve chamber. What is required is only that the pressure within the valve compartment 20 may be varied in the manner explained below.

Taking the position shown in FIG. 1 as the initial position, the operation of the illustrated valve device is as follows:

In the position shown in FIG. 1, the liquid pressure in the valve compartment 20 is presumed to be of a value related to the head pressure in the supply compartment or reservoir 22 such that the upwardly directed fluid force applied to the valve member 21 prevails over the downwardly directed fluid force or the sum of the latter and the weight of the valve member (this weight, however, is presumed to be small or fully or almost fully balanced by an Archimedean force and/or a spring force). Consequently, the sealing portion 21A of the valve member 21 is held in sealing engagement with the annular valve seat 17A. The upwardly directed force may result from, for example, the head pressure of a column of liquid in the outlet conduit 17 or a pressure produced by a piston accommodated in the housing portion 11A.

In the illustrated exemplary embodiment of the fluid valve device, the upwardly directed fluid force is applied to the valve member 21 over an annular surface A on the inner side of the valve member. The surface area of this surface A (thrust surface) as projected in the direction of the axis L of the valve device, or, in other words, the surface area which determines, in conjunction with the pressure in the valve chamber 20, the magnitude of the upwardly directed fluid force on the valve member, is determined by the outer diameter D of the valve member and the diameter d of the circular or narrow annular area over which the valve seat 17A is engaged by the sealing portion 21A (for convenience, the radial width of the surface of engagement between the valve seat 17A and the sealing portion 21A of the valve member 21 is disregarded here).

The downward fluid force is applied to the valve member 21 over a likewise annular but smaller surface B (thrust surface) on the outer side of the valve member. The surface area of this surface B as projected in the direction of the axis L is determined by the diameter Dd of the cylindrical intermediate portion of the valve member and the above-mentioned diameter d.

In the illustrated embodiment of the fluid valve device, the air compartment V constantly is in open, unrestricted communication with the surrounding atmosphere and thus is always subjected to the atmospheric pressure. Consequently, the upwardly facing annular surface C on the outer side of the valve member 21—the axially projected or effective surface area of this surface C is determined by the outer diameter D of the flared lower valve member portion and the outer diameter Dd of the cylindrical intermediate valve member portion—is not acted on by any force tending to displace the valve member upwardly or downwardly.

When the pressure in the valve chamber 20 drops sufficiently far below the pressure in the supply compartment or reservoir 22, e.g. because a pressure generated by a piston (not shown) in the housing portion 11A disappears and/or the momentum of an upwardly moving liquid column in the outlet conduit 15 tends to produce suction in the valve compartment, a situation develops in which the downward force acting on the valve member 21 prevails and moves the valve member downwardly.

As a consequence, an annular gap-like flow passage 23 is opened between the valve member 21 and the valve seat 17A, see FIG. 2. Because of the annular configuration of this flow passage 23, the cross-section area the flow passage presents to the liquid flow through it already is substantial after a short downward movement of the valve member. Hence, the liquid in the supply compartment or reservoir 22 can flow into the valve chamber 20 almost unimpededly, that is, without undergoing any significant pressure drop.

A following increase of the pressure in the valve chamber 20 with respect to the pressure in the supply compartment or reservoir 22 will cause the upward fluid force acting on the valve member to prevail so that the valve member 21 is returned to the closed position shown in FIG. 1. Such returning of the valve member may take place even before the pressure in the valve chamber 20 exceeds the pressure in the supply compartment or reservoir 22, because the effective (axially projected) surface area of the downwardly facing thrust surface A is larger than the effective (axially projected) surface area of the upwardly facing thrust surface B.

In FIGS. 3–6, which show a positive-displacement piston pump including an inlet valve in the form of a one-way fluid valve device embodying the principles of the invention, the reference numerals and letters used in FIGS. 1 and 2 are also used to designate pump elements which correspond, in respect of their functions, to the valve elements forming part of the valve device of FIGS. 1 and 2.

The pump shown by way of example in FIGS. 3–6, comprises a rigid, generally circular cylindrical pump housing 11. An inlet opening 12 is provided in the circumferential pump housing wall 11A, and an outlet opening 13 is provided in the top end wall 11C. A radial inlet conduit 14 conveying a substantially continuous stream of liquid opens into the inlet opening 12, and the outlet opening 13, which is located on the vertical axis of the pump housing 11, opens into an upwardly extending axial outlet conduit 15.

Inside the pump housing 11 the pump has a sac or bladder 16 of a thin, highly flexible but substantially inextensible film of plastic, such as polyurethane. This sac is sealingly connected with the inlet conduit 14 and, through the intermediary of a flared inlet sleeve 17 attached to the pump housing, with the outlet conduit 15. The sac 16 and the pump housing 11 are designed such that the entire pump, or at least the sac, lends itself to use as a disposable item. Throughout the height of the sac 16, its cross-sections taken perpendicularly to the axis L of the pump housing are generally circular or annular.

The bottom wall of the sac 16 rests on the top side of a vertically movable displacement member or piston 18 which is caused to reciprocate vertically at a constant or variable rate by a motor 19. The piston may be positively driven in both directions, but in the illustrated embodiment it is positively driven only upwardly through the delivery stroke.

The downward movement of the piston results from gravity, i.e. the weight of the piston and the weight of the liquid in the pump chamber 20. A contribution to the downward movement of the piston may also be given by the static or dynamic pressure of the liquid being pumped.

As the sac 16 is not secured to the piston 18, the piston does not pull the bottom wall of the sac downwardly during the downward or filling stroke. However, it is within the scope of the invention to apply a downward pulling force to the bottom wall of the sac.

The lower portion of the sac 16 defines a pump chamber 20 the side wall of which, or at least the upper portion thereof, is configured by a surrounding, substantially rigid, upwardly tapering collar 21 the cross-sections of which taken perpendicularly to the pump axis L are circular. Primarily, the function of the collar 21, the weight of which is very small, is to impart a stable configuration to the side wall of the sac 16 at the upper portion of the pump chamber. This stabilising effect may also be accomplished by other means, e.g. by making the side wall of the sac sufficiently rigid.

As shown in the drawings, in certain phases of the cycle of operation of the pump, the collar 21 extends downwardly beyond the top portion of the piston 18, which is arranged such that air can flow freely past the piston into and out of the air compartment V, which is constantly under atmospheric pressure.

The collar 21 is freely movable axially within the pump housing 11, that is, it can move up and down together with the adjacent portion of the side wall of the sac 16 without being driven by a positive-acting mechanism; the forces acting on the collar 21 and causing its upward and downward movements are generated by the liquid being pumped, as will be explained in greater detail in conjunction with the description of the operation of the pump.

In its upper portion, the section of the sac 16 which defines the pump chamber 20 merges, by way of a constriction or waist at the top edge 21A of the collar 21, with a sac section which defines an annular supply compartment or reservoir 22. This reservoir 22 surrounds and is partly defined by the outlet sleeve 17 and communicates with the pump chamber 20 through an annular inlet passage 23 defined between the top edge 21A of the collar 21 and the valve seat 17A at the flared lower end of the sleeve 17. The inlet conduit 14 is constantly in open, unrestricted communication with the reservoir 22 which is expandable by the inflowing liquid.

A thrust ring 24, which is constantly urged downwardly by a weak compression spring 25, engages the top wall of the sac 16, that is, the wall of the sac 16 which forms the top wall of the reservoir 22. The pressure within the reservoir 22 produced by the thrust ring is very low, however, at least until the reservoir has been substantially expanded and thus has compressed the spring heavily.

Figure 3:
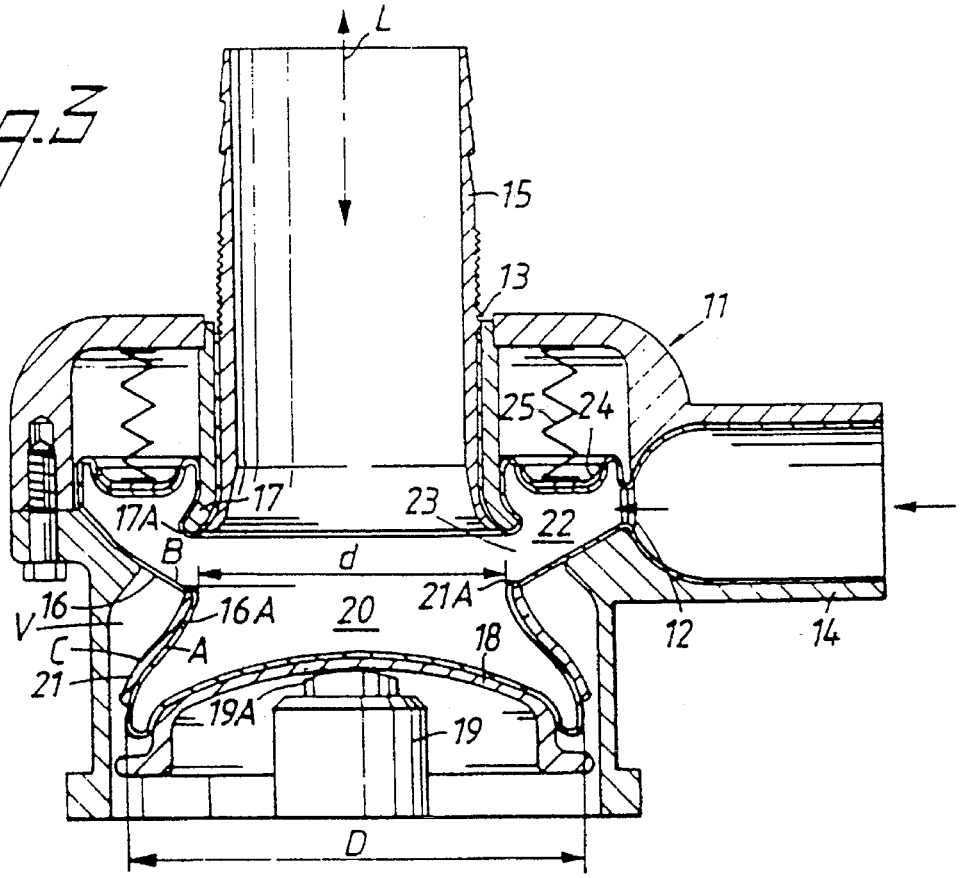
FIGS. 3 to 6 are diagrammatic vertical sectional views of a positive-displacement pump for pumping liquid and show four successive phases of a pumping cycle.

An operating cycle of the pump will now be explained, starting from the condition or the phase Of the operating cycle illustrated in FIG. 3, in which the piston 18 is presumed to be moving downwardly towards its lower end position and to have reached a point near that end position. The collar 21 is at or near a lower end position so that the inlet passage 23 has its maximum or almost its maximum height. The fluid, a liquid, then flows into the pump chamber 20 through the inlet passage 23 without undergoing any significant pressure drop. The liquid is supplied both directly from the inlet conduit 14 and indirectly from this conduit by way of the reservoir 22.

Because the inlet passage 23 has a large cross-section area for the inflowing liquid and because its length as measured in the direction of the liquid flow through it, that is, in the radial direction, is very small, it presents an extremely low resistance to the flow of liquid from the inlet opening 12 and the reservoir 22. For that resaon, the inflow of liquid into the pump chamber 20 from the reservoir 22 can take place almost entirely independently of the more or less continuous inflow from the inlet opening 12 and the inlet conduit 14. Thus, the inflow from the inlet opening 12 and the inlet conduit 14 is virtually unaffected by the discharging of the reservoir 22.

Because the discharge into the pump chamber 20 of the liquid accumulated in the reservoir 22 does not interfere with the inflow of liquid from the inlet opening 12 and the inlet conduit 14 and because the resistance to flow of liquid through the inlet passage 23 is very small, the reservoir 22 can be discharged extremely rapidly, even though the biasing action exerted on the liquid in the reservoir 22 by the thrust plate 24 and the compression spring 25 is not very strong. Factors which contribute to the rapid discharge of the reservoir are:

- The biasing device 24/25 need only accelerate the liquid volume which is discharged from the reservoir 22, because the liquid flowing from the inlet 12/14 direct into the pump chamber 20 need neither be retarded nor be accelerated;
- The distance that the discharging liquid has to travel is very short;
- The resistance to flow that the discharging liquid encounters is extremely small.

As long as the liquid flows into the pump chamber 20 through the inlet passage 23 from the inlet 12/14 and the reservoir 22, the pump chamber 20 expands, provided that the pump piston 18 is still free to move downwardly. In the illustrated embodiment of the pump, the expansion takes place without any external force tending to pull the bottom wall of the sac 16 downwards and thereby tending to produce a sub-atmospheric pressure in the pump chamber 20 (but as mentioned, it is within the scope of the invention to provide for such a force to assist in the expansion of the pump chamber). Accordingly, in the illustrated embodiment of the pump, the filling of the pump chamber 20 is governed by the inflow of liquid from the inlet conduit 14 and the reservoir 22.

When the pump piston 18 is stopped at its lower end position or is stopped before it reaches its lower end position because it engages the upwardly moving driving member 19A of the motor 19, the collar 21 and the constricted upper portion of the side wall 16A of the sac 16 will move upwardly to a position in which they sealingly engage the downwardly facing valve seat 17A on the flared lower portion of the outlet sleeve 17 so that the inlet passage 23 is closed and continued inflow into the pump chamber 20 is prevented. Accordingly, the collar 21 and the associated portion of the sac 16 constitute an inlet valve member for the pump chamber 20.

The movement of the collar 21 to the just-mentioned position (closed valve) is governed by the pressure of the liquid in the pump chamber 20 and the pressure in the inlet 12 and the reservoir 22. The pressure of the liquid in the pump chamber 20 applies to the sac 16, and thus to the collar 21, an upwardly directed force over a downwardly facing, axially projected annular thrust surface A on the collar; this annular thrust surface has an outer diameter D and an inner diameter d, see FIG. 3. This force tends to displace the collar 21 upwardly with respect to the pump piston 18.

At the same time, the collar 21 is acted on by, in addition to the fairly small downward force resulting from the weight of the collar, a downward force resulting from the action of the pressure of the liquid in the reservoir 22 on an upwardly facing, axially projected annular thrust surface B of the sac. The inner diameter of the annular thrust surface B is constant and equal to the inner diameter d of the first-mentioned annular thrust surface A, and its outer diameter varies during the movement of the collar 21; as is apparent from a comparison of FIG. 3 and FIG. 4, the outer diameter, and thus the surface area of the annular thrust surface B, is at its maximum when the collar is in its top position (closed valve) and decreases during the downward movement of the collar.

During the "steady state" phase of the portion of the operating cycle of the pump in which the inflow to the pump chamber 20, that is, the filling of the pump chamber, takes place, the interaction of forces is such that the collar 21 is acted on by a resultant force which maintains the collar in its lowermost position or at any rate at a distance from the valve seat 17A, so that the valve is kept open.

Figure 4:
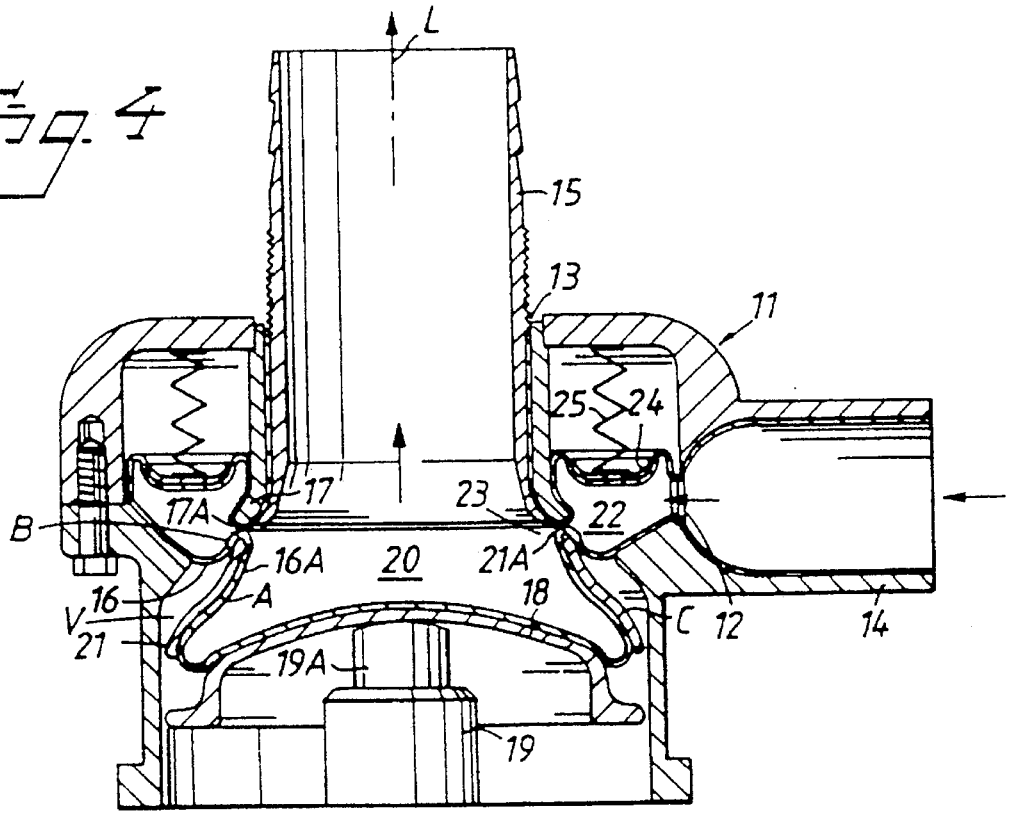

When the inflow into the pump chamber 20 ceases, which may result from stopping the pump piston 18 in its lower end position, so that continued expansion of the pump chamber is prevented, or from the motor 19 beginning to move the pump piston 18 upwardly, or from a backflow tending to develop in the outlet conduit 15, the resultant liquid-pressure force acting on the collar 21 is reversed, so that the collar is displaced upwardly to the position shown in FIG. 4 (closed valve). This movement of the collar 21 can take place even before there is a tendency to backflow through the passage 23. Thus, the closing movement may very well occur or at least be initiated before such a tendency has developed, that is, even before the inflow to the pump chamber 20 through the passage 23 has ceased.

Figure 5:
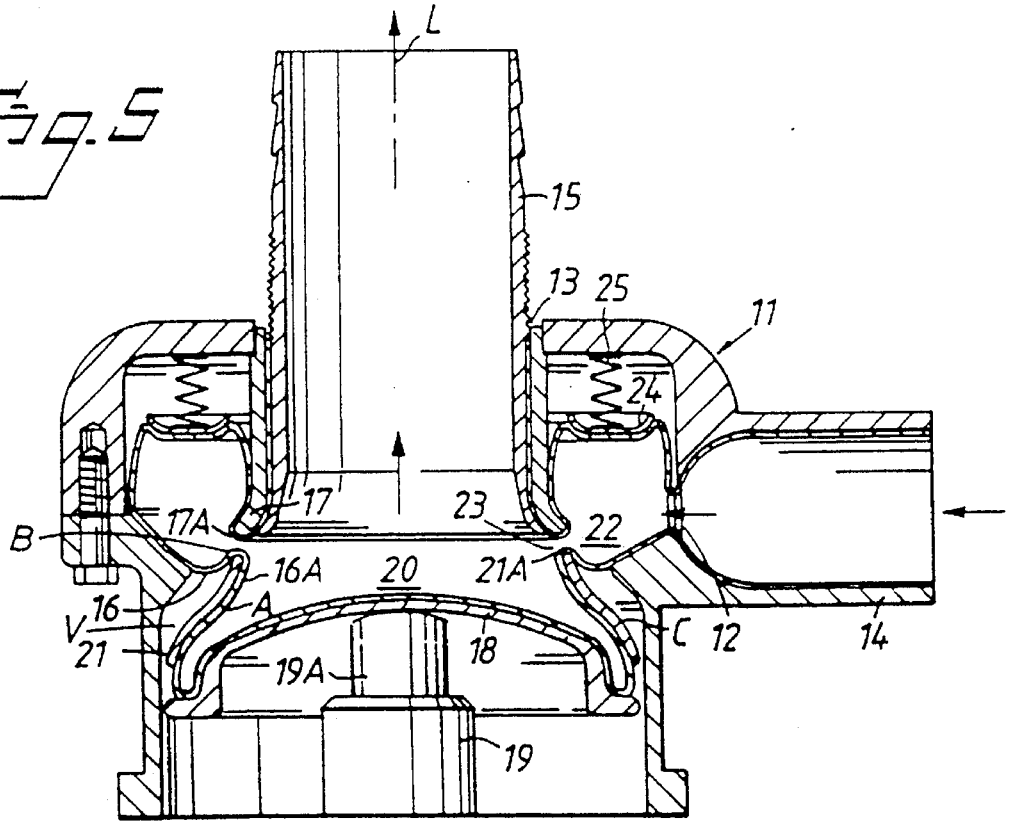

When the pump piston 18 moves upwardly after the valve member formed by the collar 21 and the adjacent portions of the sac sidewall 16A has engaged the flared portion or valve seat 17A of the outlet sleeve 17, the pump chamber 20 is contracted by the upwardly moving pump piston 18 so that the liquid in the pump chamber is expelled through the outlet sleeve 17 and the outlet conduit 15 (FIG. 4). Although the valve is closed, liquid may still flow to the pump through the inlet conduit 14, because the liquid supplied when the valve is closed is accommodated by the reservoir 22 which expands against the relatively weak force of the spring 24 (FIG. 5). In the initial phase of the expansion, the spring force is very small, so that the inflow through the conduit 14 may continue even when the incoming liquid is at a very low pressure. Only when the reservoir 22 approaches its maximum volume, the spring force increases sufficiently to substantially oppose or even stop the inflow.

Naturally, the pump should be dimensioned with consideration given to the flow rate of the inflow which it is meant to handle, so that the reservoir 22 can normally accommodate the liquid supplied during the closed phases of the valve without having to expand to near its maximum volume. This prevents the inflow to the pump through the inlet conduit 14 from becoming unduly retarded or even stopped during the discharge or ejection periods when the inlet valve is closed.

Figure 6:
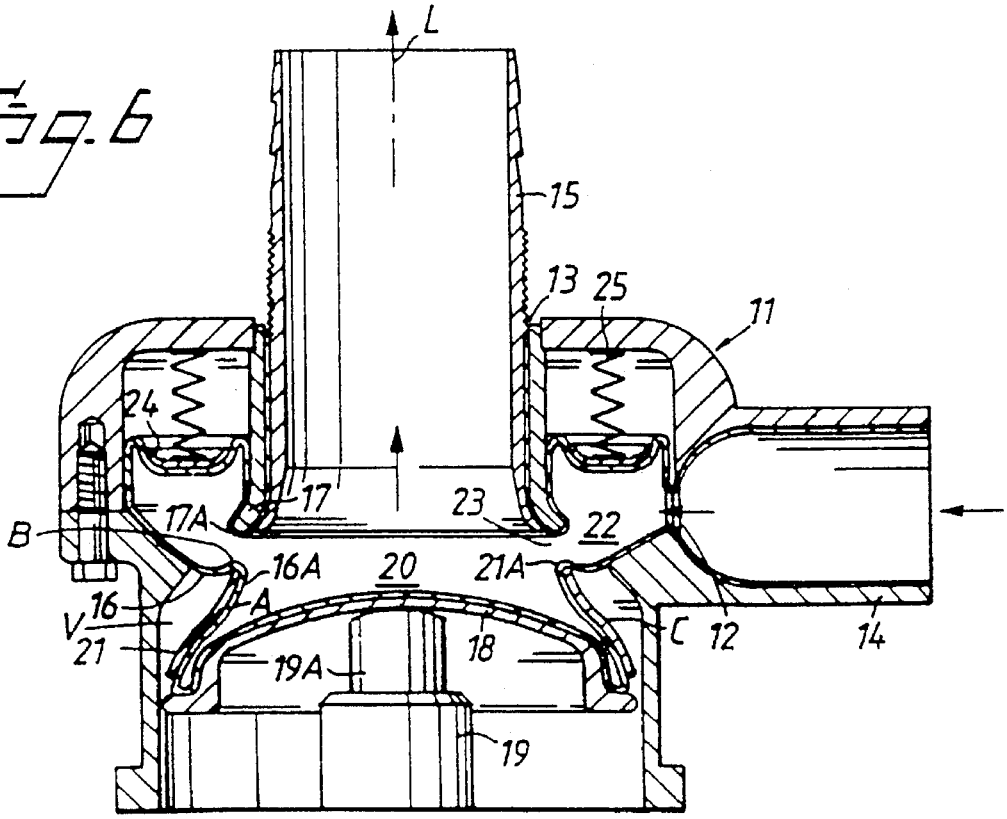

When that phase of the operating cycle which comprises the expulsion of the liquid from the pump chamber 20 approaches or reaches its end (FIG. 5), the resultant liquid-pressure force acting on the collar 21 is again reversed so that the collar returns toward the position corresponding to open valve, see FIG. 6. The inflow into the pump chamber 20 can thus start again.

Depending on the rate at which the pump piston 18 is reciprocated and on the momentum of the liquid being discharged from the pump chamber, a portion of the liquid entering the pump chamber may flow directly out of the pump chamber through the outlet conduit 15 while the expansion of the pump chamber takes place. It has also been found that when the stroke rate of the pump is sufficiently high, the outgoing flow is almost constant because of its momentum. The volumetric variations of the reservoir 22 over the pump cycle then are very small.

In the embodiments of the valve device shown in FIGS. 1–6 the flow passage 23 is opened all the way round the pump chamber. Such a continuous flow passage is advantageous, because the maximum cross-section area and an advantageous flow pattern are achieved. It is within the scope of the invention, however, to use a portion of the circumference for a radial outlet from the pump chamber. This outlet may be positioned diametrically opposite to the inlet, but it is also possible to position the inlet and the outlet side by side.

In the just-mentioned case, in which the fluid is discharged from the pump chamber 20 through a radial outlet and the inlet passage 23 between the valve member 21 and the valve seat 17A thus does not extend all the way round the pump chamber, it may be preferred to mount the valve member such that it can be pivoted about an axis which is in a plane parallel to the plane containing the valve seat and which preferably passes through or near the ends of the inlet passage, In such case, the height of the opened passage will increase gradually from the pivot axis to a maximum at the side of the pump chamber which is diametrically opposite the outlet.

Several modifications of the valve device and the pump illustrated in the drawings can be made within the scope of the invention.

For example, while in the illustrated embodiments the entire fluid force acting on the valve member in the closing direction is applied directly on the valve member, it is possible within the scope of the invention to apply it indirectly, at least partly, such as through a mechanical transmission, from a fluid pressure device which converts the fluid pressure in the valve chamber or the pump chamber into an upward force which is applied to the valve member. Moreover, in a modification of the pump shown in FIGS. 3–6, the pump piston during its downward movement displaces a fluid volume in the driving device. This displaced fluid volume is used during part of the downward movement of the pump piston, namely toward the completion of the filling of the pump chamber, to cause displacement of a force-transmittning element upwardly and to thereby apply an upward, that is, closing force on the valve member.

Within the scope of the invention, it is also possible to provide for a biasing force, such as a gravity force or a spring force, constantly acting in the closing or in the opening direction on the valve member, so that the valve member always tends to move to a predetermined position, such as the closed position, when the fluid forces which are generated in normal operation are not present.

In the illustrated embodiments, the air compartment V is always under atmospheric pressure, so that the thrust surface C does not contribute to the opening or closing force applied to the valve member. However, especially when the valve device according to the invention is used in a positive-displacement pump, the pressure in the air compartment may be caused to vary over the pumping cycle. This can be accomplished by making the air compartment V a part of the total volume of a fluid system the remaining volume of which is matched with the maximum and minimum volumes of the air compartment V such that the pressure in compartment V varies in a predetermined manner over the pumping cycle and thereby contributes to the fluid forces acting on the valve member in the direction of movement thereof.

It should also be noted that even though it is advantageous in some applications of the valve device according to the invention, the thrust surface B facing the valve seat 17A which is provided in the illustrated embodiments and contributes to displacing the valve member in the opening direction, is not indispensable. Thus, the diameter of the sealing portion 21A of the valve member 21 may be equal or nearly equal to the diameter which is designated by Dd in the drawings. In such case, the resulting fluid force is determined only by the differential pressure over the thrust surfaces A and C.

The positive-displacement pump illustrated by way of example is particularly suitable for use as a blood pump. In such use of the pump, the inside of the sac 16 and any other surfaces contacted by the blood being pumped should have a lining or coating of human or animal tissue (such as pericardium of swine) so that the surfaces coming into contact with the blood have the best possible compatibility with the blood.

I claim:

1. A fluid valve device comprising a first fluid port (12), a second fluid port (15), a flow passage which extends between the first and second fluid ports and includes a valve seat (17A), a valve member (16A,21) which is movable between an open position, in which the valve member is spaced from the valve seat and the flow passage is open, and a closed position, in which the valve member engages the valve seat and blocks the flow passage, the valve member being displaceable between the open and closed positions by fluid forces applied to the valve member by a fluid contained in the flow passage, characterised in that the valve member (16,21) is hollow and a cavity thereof defines a valve chamber (20) which communicates with one (15) of the fluid ports through the valve seat (17A), and in that a valve member actuating means (A) is associated with the valve chamber (20) for translating the pressure of fluid received in the valve chamber from the inlet (12/14) into a force which is applied to the valve member (16,21) to displace it relative to the valve seat (17A).

2. A fluid valve device according to claim 1, characterised in that the valve member actuating means (A) has a thrust surface (A) facing away from the valve seat and forming part of the wall of the valve chamber, whereby the fluid pressure in the valve chamber applies a force to the thrust surface tending to displace the valve member.

3. A fluid valve device according to claim 2, characterised in that the valve member (16A) has a second thrust surface (C), which faces the valve seat (17A) and defines a space (V) isolated from the flow passage.

4. A fluid valve device according to claim 2 or 3, characterised in that the valve member (16A,21) has a third thrust surface (B) which is situated in the flow passage outside the valve chamber.

5. A fluid valve device according to claim 4, characterised in that the surface area of the third thrust surface (B) is variable in dependence on the displacement of the valve member (16A,21).

6. A fluid valve device according to claim 5, characterised in that the valve member (16A,21) in the open position thereof defines a gap (23) which extends over the major portion of, and preferably throughout or the circumference of the valve chamber (20).

7. A fluid valve device according to claim 6, characterised in that a reservoir chamber (22) is provided adjacent the valve member (16A,21) on the side of a valve seat (17A) which in the closed position of the valve member is situated outside the valve chamber (20).

* * * * *